United States Patent [19]

Hugon

[11] 4,238,677

[45] Dec. 9, 1980

[54] SMOKE DETECTOR BY IONIZATION ASSOCIATED TO A VELOCIMETRIC MEASUREMENT ELECTRONIC CIRCUIT

[75] Inventor: Emile L. Hugon, Paris, France

[73] Assignee: Societe Gamma-Electronic, Paris, France

[21] Appl. No.: 892,390

[22] Filed: Mar. 31, 1978

[30] Foreign Application Priority Data

Apr. 8, 1977 [FR] France ..... 77 10719

[51] Int. Cl.[2] ..... G08B 17/10

[52] U.S. Cl. ..... 340/629; 250/381

[58] Field of Search ..... 340/628, 629; 250/381, 250/382, 384, 385

[56] References Cited

U.S. PATENT DOCUMENTS

| | | | |
|---|---|---|---|
| 3,665,441 | 5/1972 | Suchomel et al. | 340/629 X |
| 3,666,954 | 5/1972 | Sasaki et al. | 340/629 X |
| 3,812,362 | 5/1974 | Larsen et al. | 340/629 X |
| 3,872,449 | 3/1975 | Scheidweiler | 340/629 |
| 3,906,474 | 9/1975 | Lehsten | 340/629 |
| 3,909,815 | 9/1975 | Gacogne | 340/629 |
| 4,020,415 | 4/1977 | Webb, Jr. | 340/629 X |
| 4,041,479 | 8/1977 | Miyabe | 340/629 |
| 4,097,851 | 6/1978 | Klein | 340/629 X |

*Primary Examiner*—John W. Caldwell, Sr.
*Assistant Examiner*—Daniel Myer
*Attorney, Agent, or Firm*—Barry Kramer

[57] ABSTRACT

An alarm device for detecting smoke, fire or the like includes a reference and measurement chamber for comparing the character of the ambient atmosphere with a volume of reference gas, and a radioactive source for ionizing the contents of each of the chambers. Electrodes communicating with each of the chambers measures an electric field within each of the latter indicative of the degree of ionization of the contents thereof. An electronic circuit senses the relative difference of the signals produced by the electrodes associated with each of the chambers and activates an alarm when a signal of predetermined magnitude is sensed indicating the presence of smoke or the like in the area of the detector. The electronic circuit includes: memory circuit means for filtering out spurious electrical signals produced by temporary short circuit conditions in the device; a comparative discriminator circuit for compensating for slow occurring variations in the character of the contents of each of the chambers; and, a time delay circuit for suppressing alarm signals in the event of a temporary short or open circuit condition in the device.

11 Claims, 2 Drawing Figures

SMOKE DETECTOR BY IONIZATION ASSOCIATED TO A VELOCIMETRIC MEASUREMENT ELECTRONIC CIRCUIT

TECHNICAL FIELD

This invention deals with smoke and fire detectors of the type in which detection is performed by measuring ionization of the ambient environment, and deals more particularly with a detector provided with an electronic velocimetric circuit which screens out spurious, false alarm signals produced by pollutants within the ambient environment, inadvertant shortterm connecting or disconnecting of the detector, electrical interference signals, faulty insulation of electrical components, variations in supply voltage, and the like.

BACKGROUND AND BRIEF DESCRIPTION OF THE INVENTION

Various types of detectors have been devised in the past wherein a pair of electrodes disposed within a reference chamber and a measurement chamber are employed to measure changes in the level in ionization within the respective chambers which are produced by the presence of smoke, gas or aerosols within the measuring chamber. The presence of smoke or other similar foreign elements within the measuring chamber results in a change in the electric field between the electrodes of such chamber which in turn produces an electric signal. The electric signal produced by changes in the electric field within the measuring chamber is then compared to the electric signal produced by the electrodes in the reference chamber and the resultant signal is subsequently applied to electric instrumentation such as a vacuum tube, field effect transistors or other amplifying means in order to produce a signal for triggering an alarm.

Prior art detectors of the type described above include a number of difficiencies. First, prior art detectors which are highly sensitive are unable to discriminate between an alarm signal produced as a result of the detection of pollutive contaminates which are suspended in the ambient environment, and genuine alarm signals produced by smoke, fire or the like. In some cases, these prior detectors may trigger false alarms as a result of faulty insulation of electrical components or leads within the electrical circuit of the detector that may produce temporary, intermittent short circuits. Similarly, the electronic circuits associated with prior detectors are incapable of differentiating between genuine alarm signals and those signals produced by the effects of the electrical interference, variation in supply voltage, temporarily cutoff in the electrical supply and faulty operation of a detector head. Also, these detectors are prone to producing false alarm signals as a result of chemical or electrochemical corrosion caused by the atmosphere within the measuring chamber.

The present invention overcomes the disadvantages inherent in prior art detectors of the type described above. The detector of the present invention employs means which prevent corrosion of the detector heads whereby to eliminate the production of false alarm signals due to the inadvertant detection of corroded materials within the ionization chambers.

A time delay circuit is provided for preventing premature delivery of an alarm signal produced as a result of a temporary short or open circuit condition in the detector which is unrelated to an alarm condition.

Memory circuit means are provided which operate on the electrical alarm signals to temporarily memorize and hold the latter in order to filter out components in such signals which are produced by temporary short circuit conditions or random electrical noise in the detector circuit. According to the present invention, there is provided a reference chamber containing a volume of reference gas therein, and a measurement chamber communicating with the ambient atmosphere for containing a volume of air characteristic of the surrounding atmosphere. A radioactive source disposed adjacent each of the chambers ionizes the contents in each of the chambers. Each of the chambers is formed by a varnished enclosure structure. A pair of electrodes are coupled with each of the chambers and are polarized by dc current, each pair of which electrodes function, in effect, as a pair of capacitors. A change in the degree of ionization within either of the chambers results in a change in the electric field between the electrodes of the corresponding chambers. Normally, the electric field, and thus the electric current flow, between the electrodes in the reference chamber remains essentially constant, while the electric field, and resulting current flowing between the electrodes in the measuring chamber changes in relation to the chemical composition of the air in the ambient atmosphere which is allowed to circulate through the measuring chamber. Combustible products such as smoke or the like produced by a fire in the vacinity of the detector drifting into the measuring chamber are ionized and result in a change in the magnitude of the electric field between electrodes in the measuring chamber, thereby giving rise to a change in current flow between such electrodes. The change in current derived from the measuring chamber is amplified by an electronic circuit and is employed to produce a visual or audible alarm.

A velocimetric circuit operably coupled with each of the ionization chambers functions to adjust the impedance of the detector, thereby adjusting the quiescent operating point of the detector, and functions to compare the rate of increase in the magnitude of the electric signals derived from the electrodes of the respective ionization chambers in order to eliminate those components of such signals produced as a result of electrical interference or defective insulation of portions of the circuit in the detector.

Memorization circuit means are provided to analyze and differentiate between electrical signals of various types corresponding to different stimuli such as flame, temperature variation, etc. A first visual or audible annunciator is responsive to an alarm signal produced by the detector circuit to announce the existence of an alarm condition, while a second annunciator is responsive to the production of alarm signals in the event that the first mentioned annunciator is rendered inoperative.

BRIEF DESCRIPTION OF THE DRAWINGS

In the drawings, which form an integral part of the specification and are to be read in conjunction therewith, and in which like numerals are employed to designate like parts in the various views.

DETAILED DESCRIPTION OF THE INVENTION

Figure 1:
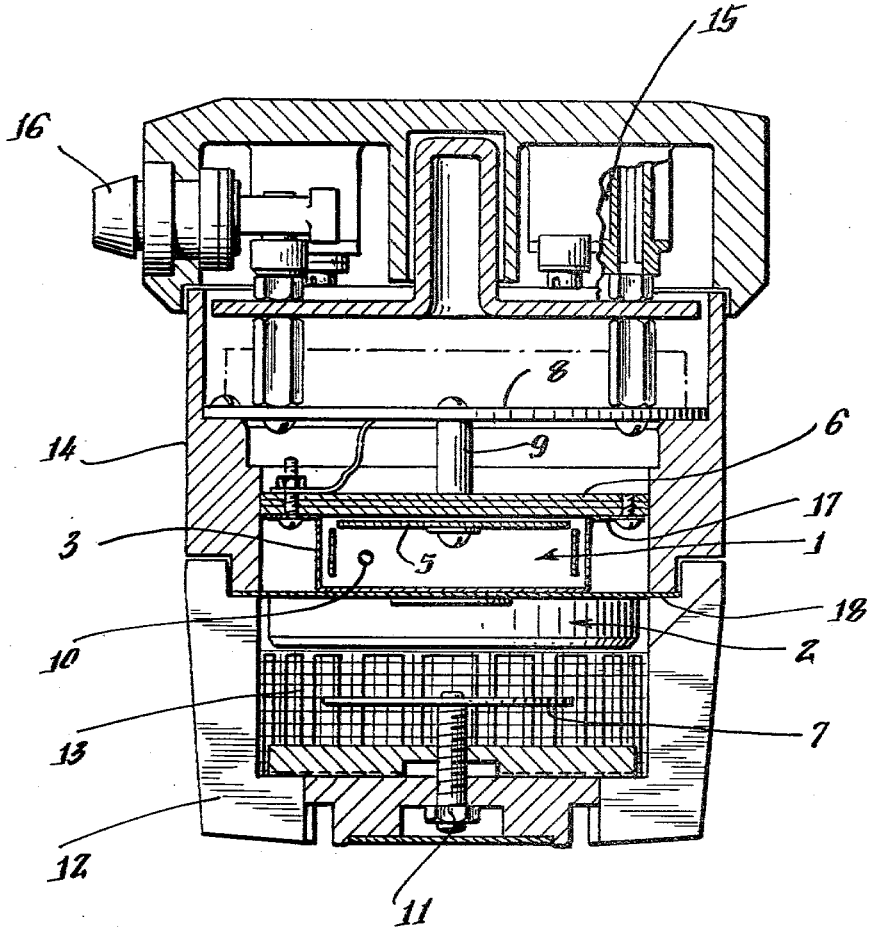
FIG. 1 is a cross-sectional view of the smoke detector apparatus which forms the preferred embodiment of the present invention.

Referring first to FIG. 1, a smoke detector apparatus includes a reference chamber 1 for containing a volume of reference gas therein and a measurement chamber 2 spaced below the reference chamber 1. Measuring chamber 2 comprises an enclosure having substantially open portions which place the interior of the chamber 2 in communication with the ambient atmosphere whereby the measurement chamber 2 contains a volume of air typical of the surrounding atmosphere therein.

The chambers 1 and 2 are coated with a silicone type insulating varnish and are separated from each other by a diaphram 3 which is fixed on epoxy glass. Diaphram 3 is made from an electrically conductive material and comprises a conducting membrane which separates chambers 1 and 2 and provides a support for an alpha emitter, double radioactive source 5. The double radioactive source 5 preferably comprises an americium source and functions to simultaneously ionize the contents within the chambers 1 and 2. One portion of the double radioactive source 5 functions as a positive electrode which is employed for measuring the variations of an electrical field for purposes of smoke detection.

A pair of negative electrodes 6 and 7 each comprise a flat disc and are respectively disposed above and below the radioactive source 5. Electrode 6 is secured to a printed circuit board 8 by a central stem 9 and functions as a negative electrode for the reference chamber 1. The distance from the negative electrode 6 to the source 5 may be adjusted by varying the length of the central stem 9. The reference chamber 1 is essentially enclosed and is defined by diaphram 3. A volume of ordinary atmospheric air or other gas such as carbon dioxide is contained within such reference chamber, isolated and insensitive to fluctuation or variations in the ambient environment due to temperature changes, air drafts, etc. A small aperture indicated by the numeral 10 in the diaphram 3 places the measurement chamber 1 in communication with the surrounding, ambient atmosphere; however, the aperture 10 is sufficiently small to regulate the amount of ambient air which may enter the reference chamber 1 to a predetermined, relatively small rate in order that the gas within the reference chamber 1 remains insensitive to relatively rapid changes in the character of the ambient atmosphere as produced by fire related smoke. As a result of the provision of the aperture 10, chemical pollutants inherent in the ambient atmosphere are allowed to enter the reference chamber 1, whereby the character of the reference gas in the reference chamber 1 reflects the overall character (chemical composition) of the ambient atmosphere in which the smoke detector is intended to operate.

The negative electrode 7 is operatively associated with the measuring chamber 2 and is secured to an upright, adjustable support 11 in the nature of a threaded screw which permits adjustment of the distance between the electrode 7 and the positive electrode 3 which holds the radioactive source.

The reference and measurement chambers 1 and 2 respectively, are enclosed in a structure, preferably of metal, which includes a plurality of radially extending, circumferentially spaced fins or flanges 12 which circumscribe the measurement chamber 2. A cylindrical, pervious mesh like grid 13 is suitably secured to the apparatus and is disposed between the flanges 12 immediately beneath open areas of the measurement chamber 2.

The apparatus is electrically coupled to a remote power supply or the like (now shown) by electrical lines 15 suitably connected at the upper base side of the apparatus, which also is provided with a visual signal light 16 for annunciating an alarm condition.

The flanges 12 are relatively thin, in the range of approximately 1 mm thick and are circumferentially spaced at relatively close intervals, preferably on the order of 10 mm apart. The shape and dimensions of the flanges 12 are such that air, which includes gas or smoke, is canalized between adjacent flanges 12 thereby preventing accidental alarm detection as a result of sudden air drafts in the surrounding environment flowing intermittently past the apparatus. By this feature, ionic scattering in the measurement chamber which might otherwise produce a variation in the electric field therewithin created as a result of the action of air drafts is minimized.

The external casing, frame, flanges 12 and grid 13 are connected to the negative pole of an electrical circuit on the printed circuit board 8 which comprises a Faraday cage 14. Electrical coupling of the electrical circuit on the printed circuit board 8 to the cage 14 eliminates medium and high frequency electrical interference which might otherwise adversely effect the performance of the electrical components of the apparatus, particularly field effect transistors.

Figure 2:
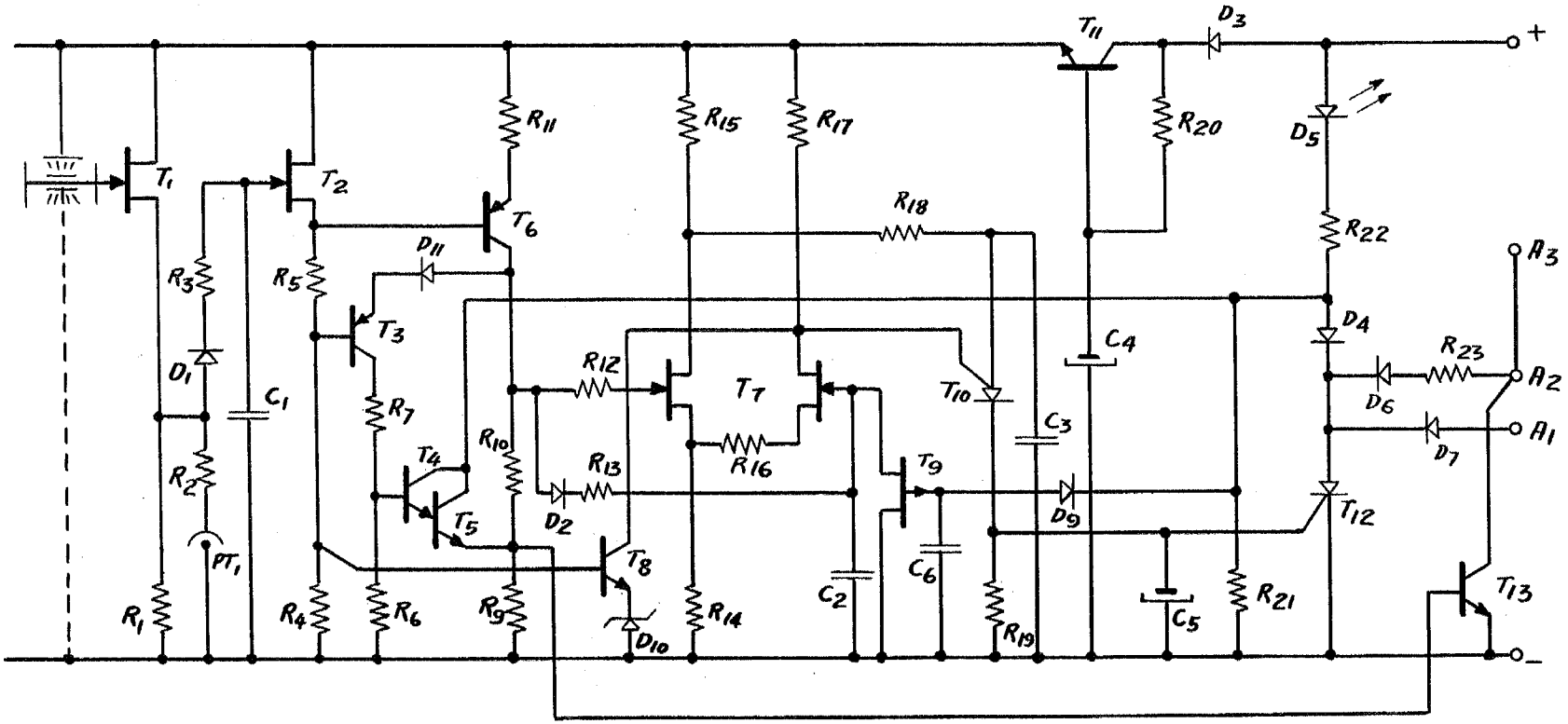
FIG. 2 is a detailed schematic diagram of an electrical circuit for velocimetric measurement of the signals produced by the detector head and for controlling the smoke detector apparatus of FIG. 1.

Attention is now directed to FIG. 2 wherein a detailed schematic diagram of the electrical circuit employed in connection with the present invention is depicted, a substantial portion of such circuit being embodied in the previously mentioned printed circuit board 8.

The combination of the reference chamber 1 and measurement chamber 2 are polarized by a direct current voltage supply of approximately 20 volts which is operably coupled to the positive and negative terminals indicated toward the right side of the circuit shown in FIG. 2. Electrodes 6 and 7, which function to provide a measurement of the electrical field within the respectively corresponding chambers 1 and 2, are coupled to the positive distribution line extending across the top of the circuit in FIG. 2 which is connected to the previously mentioned positive terminal. The common electrode 5, which is employed in providing both an ionization source and a measurement of the electrical field in combination with electrode 6 and 7, is operably coupled with the negative distribution line extending across the bottom of the circuit in FIG. 2, which latter line is connected to the previously mentioned negative terminal near the lower right hand corner of the circuit in FIG. 2.

The electrical circuit functions to measure the electric field between electrodes 5 and 6 as well as between the electrodes 5 and 7. The resulting electric field which is measured and results in electrical signals being delivered to the circuit shown in FIG. 2 corresponds to the amount or degree of ionization either in the reference chamber 1 or the measurement chamber 2. The electrical signal indicative of the magnitude of the electrical field is delivered to field effect transistor $T_1$ which functions as an impedance adaptor, and has its drain and source electrodes respectively connected to the positive and negative distribution lines, while the gate electrode thereof receives the incoming electrical signals derived from the electrodes associated with the chambers 1 and 2. The electrical signals processed by transistor $T_1$ are then delivered to memory circuit means comprising diode $D_1$, resistor $R_3$, capacitor $C_1$ and transistor $T_2$. Diode $D_1$ and resistor $R_3$ are coupled in series between the source electrode transistor $T_1$ and the gate electrode of transistor $T_2$, while capacitor $C_1$ is coupled between the gate electrode of transistor $T_2$ and the negative distribution line.

The memory circuit means mentioned above function to cancel electrical noise produced by the combination of chambers 1 and 2 and is also operative to eliminate false signal components produced as a result of temporary short circuits related to the measurement chamber 1. The resulting memorized electrical signal output by the memory circuit means has its polarity reversed and is delivered for conditioning thereof to the gate electrodes of a pair of field effect transistors which form amplifier $T_7$. Diode $D_2$ and resistor $R_{13}$ are coupled in series with each other and between the gate electrodes of the transistor pair of amplifier $T_7$. A capacitor $C_2$ is provided between the gate electrode of one of the field effect transistors in amplifier $T_7$ and the negative distribution line. Amplifier $T_7$, in combination with diode $D_2$, resistor $R_{13}$ and capacitor $C_2$ function as a comparative discriminator circuit for compensating for slowly occurring long term variations in each of the chambers 1 and 2, and in this sense, function to constantly adjust the quiescent operating point of the circuit. Stated in other terms, this last mentioned comparative discriminator circuit functions as a kinetics discriminator of the alarm signal.

The comparator $T_{10}$, herein disclosed as a thyristor is coupled with an electronic time constant circuit comprising resistor $R_{18}$, capacitor $C_3$ and resistor $R_{19}$, which function in combination with the comparator $T_{10}$ to analyze the rate of change of the components of the alarm signal and transform the same to electrical impulses which are subsequently recorded by a bistate device herein disclosed as a thyristor $T_{12}$. Thyristor $T_{12}$ has the gate electrode thereof operably coupled with the cathode of thyristor $T_{10}$, while the anode of thyristor $T_{12}$ is coupled in series relationship with diode $D_4$, resistor $R_{22}$ and light emitting diode $D_5$ to the positive distribution line, the cathode of thyristor $T_{12}$ being connected to the negative distribution line. The output of thyristor $T_{12}$ comprises a series of electrical pulses for energizing light emitting diode $D_5$ whereby to indicate the presence of an alarm condition. Alternate means for visually or audibly announcing the alarm condition may be operably coupled to the terminals $A_1$, $A_2$ and $A_3$, which are connected to the anode of thyristor $T_{12}$.

A rocking or flip-flop circuit comprises diode $D_{11}$, transistors $T_3$, $T_4$ and $T_5$, and resistors $R_6$ and $R_7$. The flip-flop circuit functions to differentiate a genuine alarm signal from a signal produced as a result of the loss of insulation in the cell comprising chambers 1 and 2 by canceling or filtering out temporary short circuit variations in the detection signal. Diode $D_5$ and resistor $R_{22}$, which controls transistor $T_{13}$, cooperate with the above-mentioned flip-flop circuit to effect cancellation of such temporary variations due to short circuits.

A time delay circuit is provided consisting of $R_{20}$, capacitor $C_4$ and transistor $T_{11}$ which functions to prevent the delivery of output alarm signals from the circuit a prescribed time interval following the occurrence of a short or open circuit condition in the apparatus. The base of transistor $T_{11}$ is operably coupled through capacitor $C_4$ to the negative distribution line, while the emitter and collector of such transistor are coupled in series with the positive distribution line. Resistor $R_{20}$ is coupled between the collector of transistor $T_{11}$ and the base thereof, while diode $D_3$ is connected in the positive distribution line, between the positive terminal and a common junction of the collector of transistor $T_{11}$ and the resistor $R_{20}$. Diode $D_3$ maintains a prescribed minimum voltage in the circuit to eliminate the transient effect of temporary power supply cutoffs as a result of connecting and disconnecting the electrical circuit to the power supply.

Turning now to the operation of the electrical circuit, once the positive and negative terminals of the circuit are connected to a suitable source of electrical supply, preferably approximately 20 volts, a preliminary adjustment of the output of amplifier $T_7$ is made by reducing the electrical charge in capacitor $C_2$ which is performed by short circuiting the latter through the field effect transistor $T_9$, diode $D_9$ and resistor $R_{21}$. Capacitor $C_6$ and diode $D_9$ function to continue the short circuit condition of capacitor $C_2$ for approximately 30 seconds time in order to assure that the output of amplifier $T_7$ is reduced to a normal quiescent state.

Thus, a prescribed time interval (30 seconds in the case of the preferred form disclosed herein) is provided in which the apparatus may reach an equilibrium state without inadvertantly announcing an alarm condition. Moreover, the time delay circuit comprising transistor $T_{11}$, resistor $R_{20}$, and capacitor $C_4$ prevent the delivery of output alarm signals from the circuit a prescribed time interval following a short or open circuit condition within the chambers 1 and 2 in order to permit the establishment of an ionization equilibrium in the detection head.

After the apparatus has been coupled to a suitable source of electrical supply and has achieved a quiescent state of equilibrium, in the absense of a detected alarm condition, current signals delivered to the field effect transistor $T_2$ correspond to variations or fluctuations attributable to electrical noise or interference inherent in the detector circuit. The magnitude of the current signal delivered to transistor $T_2$ is stored or "memorized" by diode $D_1$, field effect transistor $T_2$, resistor $R_3$ and the capacitor $C_1$.

When a foreign substance whose existence is desired to be detected, such as smoke, enters the measurement chamber 2, a substantial variation in the ionization of the air within such measurement chamber 2 occurs thereby generating a change in the impedance of the circuit which produces an increase in the conduction of the field effect transistor $T_1$. The increase conduction of transistor $T_1$ results in an increase in the current flow through resistors $R_9$, $R_{10}$, and $R_{11}$ as well as through the emitter and collector of transistor $T_6$ thereby turning on the latter and reversing current flow which is subsequently amplified and compared by the amplifier $T_7$. A portion of the resultant current flow is shunted through diode $D_2$, resistor $R_{13}$ and capacitor $C_2$ which adjusts the output of amplifier $T_7$ in a manner to compensate for ambient physical variations of a non-alarm nature. The output of amplifier $T_7$ results in a current which fires the programable transistor $T_{10}$ whose output is shunted by resistor $R_{18}$ and $R_{19}$ as well as by capacitor $C_3$. At this point, signal impulses are delivered to the thyristor $T_{12}$ which is responsive to such impulse signals to produce an electric current that is delivered through light emitting diode $D_5$ thereby energizing the latter and announcing an alarm condition.

Transistor $T_8$ and diode $D_{10}$ are merely employed as an electrical check for the announcement of an alarm in the event that the circuit has compensated to a maximum degree for random electrical noise. When the current flows through the circuit is prevented from reaching an equilibrium state because of open or short circuits, the unbalance of transistors $T_3$, $T_4$ and $T_5$ and associated resistors $R_7$, $R_8$ and diode $D_{11}$ rocks or oscillates continuously. By this feature, control of current through the diode $D_5$ and resistor $R_{22}$ is controlled and a signal is caused to be delivered to the terminal $A_2$ which may be operably with an audible or visual annunciator to annunciate a trouble condition in the circuit.

It will be observed that the smoke detector apparatus disclosed herein not only provides for the reliable accomplishment of the object of the invention, but does so in a particularly simple and effective manner. It is recognized, of course, that those skilled in the art may make various modifications or additions to the preferred embodiment chosen to illustrate the invention without departing from the gist and essence of the present contribution to the art. Accordingly, it is to be understood that the protection sought and afforded hereby should be deemed to extend to the subject matter claimed and all equivalents thereof fairly within the scope of the invention.

What is claimed is:

1. An alarm device for detecting smoke, fire or the like, comprising:

a reference chamber for containing a volume of reference gas therein;

a measurement chamber communicating with the ambient atmosphere for containing a volume of air in said ambient atmosphere therein;

means adjacent each of said chambers for ionizing the contents of each of said chambers;

means communicating with each of said chambers for sensing variations in the degree of ionization of the contents of each of said chambers, said ionization sensing means including means for producing electrical signals corresponding to said degree of ionization and comprising electrode means coupled with each of said chambers for measuring the magnitude of an electric field in each of said chambers; and means coupled with said electrode means for eliminating unwanted interference and noise components in said electrical signals, said eliminating circuit means comprising:

(1) memory circuit means for operating on said electrical signals to temporarily memorize and hold the latter whereby to filter out components in said electrical signals produced by a temporary short circuit condition in said device, (2) a comparative discriminator circuit operably coupled with said memory circuit means for compensating for slow occurring, long term variations in the contents of each of said chamber, and (3) a time delay circuit coupled with said memory circuit means and said comparative discriminator circuit means for preventing delivery of output signals from said device a prescribed time interval following the occurrence of a short or open circuit condition in said device.

2. The device of claim 1 wherein said ionization means comprises a radioactive source.

3. The device of claim 1, including means coupled with said reference chamber placing the interior thereof in communication with the ambient atmosphere for altering the character of the contents of said reference chamber in accordance with slow occurring changes in the character of the ambient atmosphere.

4. The device of claim 1, wherein the interior surface areas of each of said chambers is provided with a coating of silicone thereon.

5. The device of claim 1, including a plurality of circumferentially spaced radially extending flanges circumscribing said measurement chamber for canalizing air entering said measurement chamber from said ambient atmosphere.

6. The device of claim 1, wherein said electrode means comprises a first and second spaced apart positive electrodes, and a radioactive negative electrode interposed between said first and second positive electrodes.

7. The device of claim 1, wherein said memory circuit means comprises a field effect transistor, a resistor and diode coupled in series with each other and with the gate electrode of said transistor, and a capacitor coupled with said gate electrode of said transistor and in parallel relationship to the combination of said resistor and said diode.

8. The device of claim 1, wherein said comparator discriminator circuit comprises amplifier means including a pair of transistors, a diode and resistor coupled in series relationship with each other, and a capacitor coupled with said amplifier means and with the combination of said diode and said resistor.

9. The device of claim 8, including means adapted for activating an alarm comprising a comparator circuit operably coupled to said amplifier means and including a programmable, unijunction transistor for comparing a pair of electrical signals respectively corresponding to the quiescent state of said device and an alarm state of said device.

10. The device of claim 1, including a flip-flop circuit operably coupled with said memory circuit means and comprising a plurality of cascaded amplifiers operable to produce a signal indicative of a loss of electrical insulation in one of said chambers.

11. The device of claim 9, wherein said means for activating said alarm further includes a thyristor operably coupled with said programmable unijunction transistor and under control of the latter mentioned transistor.

* * * * *